US006131430A

United States Patent [19]

Schneider et al.

[11] Patent Number: 6,131,430

[45] Date of Patent: Oct. 17, 2000

[54] TOOL AND METHOD FOR THE ROLLING TREATMENT OF A WORKPIECE

[75] Inventors: Albrecht Schneider, Oberursel, Germany; Peter Lassnig, Gothenburg, Sweden

[73] Assignee: Mate Precision Tooling Inc., Anoka, Minn.

[21] Appl. No.: 09/258,317

[22] Filed: Feb. 26, 1999

[30] Foreign Application Priority Data

Oct. 20, 1998 [DE] Germany ..... 198 48 153
Oct. 20, 1998 [DE] Germany ..... 198 48 144

[51] Int. Cl.[7] ..... B21D 17/04

[52] U.S. Cl. ..... 72/75

[58] Field of Search ..... 72/75, 133, 179, 72/379.2

[56] References Cited

U.S. PATENT DOCUMENTS

| | | | |
|---|---|---|---|
| 629,245 | 7/1899 | Frank | 72/75 |
| 1,240,791 | 9/1917 | Czajka | 72/75 |
| 2,491,317 | 12/1949 | Klocke | 72/441 |
| 4,166,370 | 9/1979 | Goodman . | |
| 4,343,210 | 8/1982 | Kuroyone . | |
| 5,555,759 | 9/1996 | Rosene et al. . | |
| 5,575,168 | 11/1996 | Rosene et al. . | |
| 5,655,396 | 8/1997 | Siler . | |
| 5,682,782 | 11/1997 | Rosene et al. . | |
| 5,787,775 | 8/1998 | Stevens et al. . | |

FOREIGN PATENT DOCUMENTS

| | | |
|---|---|---|
| 1281372 | 12/1961 | France . |
| 60006223 | 6/1983 | Japan . |
| 2-247021 | 10/1990 | Japan . |
| 212 893 | 11/1961 | Sweden . |
| 97/36702 | 10/1997 | WIPO . |

*Primary Examiner*—Lowell A. Larson
*Attorney, Agent, or Firm*—Larson & Taylor, PLC

[57] ABSTRACT

A deforming tool for forming an elongated deformation in a planer workpiece includes cooperating upper and lower parts, a roller ball being mounted in one of the parts and cooperating with a mating element in the other part, the workpiece being engaged above and below by the two parts. The roller ball is mounted for universal movement and thus allows for sharper turns when moving the workpiece without the risk of damage to the workpiece.

13 Claims, 6 Drawing Sheets

6
4
5
1
50
3
2
16
16
21
15
9
12
12
10
10
7
20
11
20
11
17
20
11'
18
52
51

TOOL AND METHOD FOR THE ROLLING TREATMENT OF A WORKPIECE

FIELD OF THE INVENTION

The invention relates to a punch press type tool and method for forming an elongated deformation in a flat workpiece by moving the panel relative to rolling elements which engage, deform and roll along the workpiece.

BACKGROUND OF THE INVENTION

Conventional punch presses are known for punching holes in and shaping flat panels such as flat sheet metal. In these punch presses, as shown in U.S. Pat. No. 4,343,210, the flat sheet metal panel is passed between upper tools and lower dies mounted on a punch press. As the workpiece is moved to a correct position, each tool punches a hole or forms a shape in the workpiece.

It is also known in the art to replace the punching tools of these workpieces with shaping tools which form a continuous shape, i.e., a groove or the like, in the flat sheet metal workpiece.

One way to form such an elongated shape is by nibbling. Nibbling is performed by a tool having a semi-spherical part and a recessed part between which the workpiece is positioned as shown in Japanese Patent No. 2247021. The tool performs a series of rapid short vertical strokes to form indentations, ultimately creating a groove in the workpiece. Tools of this type suffer from the drawback that the series of connected indentations which are formed are not nearly as smooth as a continuous groove formed by rollers.

Another known way to form a continuous shape is by using a tool having upper and lower parts with mating cylindrical rollers rotatable about parallel horizontal axes. Such tools are known, for example, from U.S. Pat. No. 5,555,759, which discloses a tool having upper and lower cylindrical rollers, rotatable about axes which are parallel to the workpiece to be treated, the workpiece being positioned between the rollers. A major drawback of this structure is that the workpiece can only be turned about a relatively wide arc since the rollers move linearly, thereby reducing the ability to make turns about a narrow arc. In other words, if the workpiece is turned about a narrow arc or point, the rollers will slide laterally, causing damage to the workpiece.

SUMMARY OF THE INVENTION

It is, therefore, an object of the present invention to provide a tool for deforming a workpiece having a simpler construction and greater range of motion than the prior art devices. It is another object to provide a new and improved method for deforming a flat workpiece.

The present invention comprises a deforming tool having cooperating upper and lower parts mounted or adapted to be mounted in the upper and lower turrets or tool holders of a punch press. The upper part is urged downwardly against the lower part, shaping a flat workpiece located therebetween. One of the upper and lower parts carries a roller ball mounted for universal rolling movement, while the other part carries elements which mate with the roller ball such that the roller ball and the mating elements form a groove in a workpiece which is moved along while engaged by the roller ball and mating elements.

In a preferred embodiment, two roller balls are positioned in either the upper or lower parts. A single roller ball is seated in the other of the upper and lower parts and is offset so as to be aligned between the two roller balls, creating a wave-shaped gap therebetween.

Preferably, each individual roller ball is retained in a cylindrical holder having a hemispherical bearing shell therein allowing for universal rolling movement of the roller ball. A holding ring, which has an interior diameter that is smaller than the largest diameter of the roller ball, retains the roller ball in the holder.

In a preferred embodiment, the roller ball is mounted in the lower part and the mating element, preferably the two roller balls, are mounted in the upper part. In accordance with variations of the present invention, the mating element may be a fixed, wave-shaped element instead of two roller balls. Also, the mating element, whether a pair of roller balls or fixed elements, can comprise different sizes and/or shapes from each other in order to form a groove which is asymmetrical across its width.

The tool of the invention may further allow for length adjustment of the upper part to provide more precise placement of the tool into its operating position or for purposes of treating workpieces having different thicknesses without the need to adjust the entire system.

The invention is also directed to the method of deforming a workpiece using the tool of the invention. In accordance with the method, the upper part of the tool is moved vertically downward to engage the top of the workpiece. The lower part of the tool engages the bottom of the workpiece. A universally rolling roller ball mounted in either the upper part or the lower part of the tool engages the workpiece and acts on the workpiece in conjunction with a mating element in the other of the upper and lower parts. The workpiece is then moved between the roller ball and mating element to create a deformation in the workpiece.

These and other objects of the invention will be apparent from the detailed description to follow.

BRIEF DESCRIPTION OF THE DRAWINGS

There follows a detailed description of the preferred embodiments of the present invention which are to be taken together with the accompanying drawings, wherein.

DETAILED DESCRIPTION OF THE PREFERRED EMBODIMENT

Figure 1:
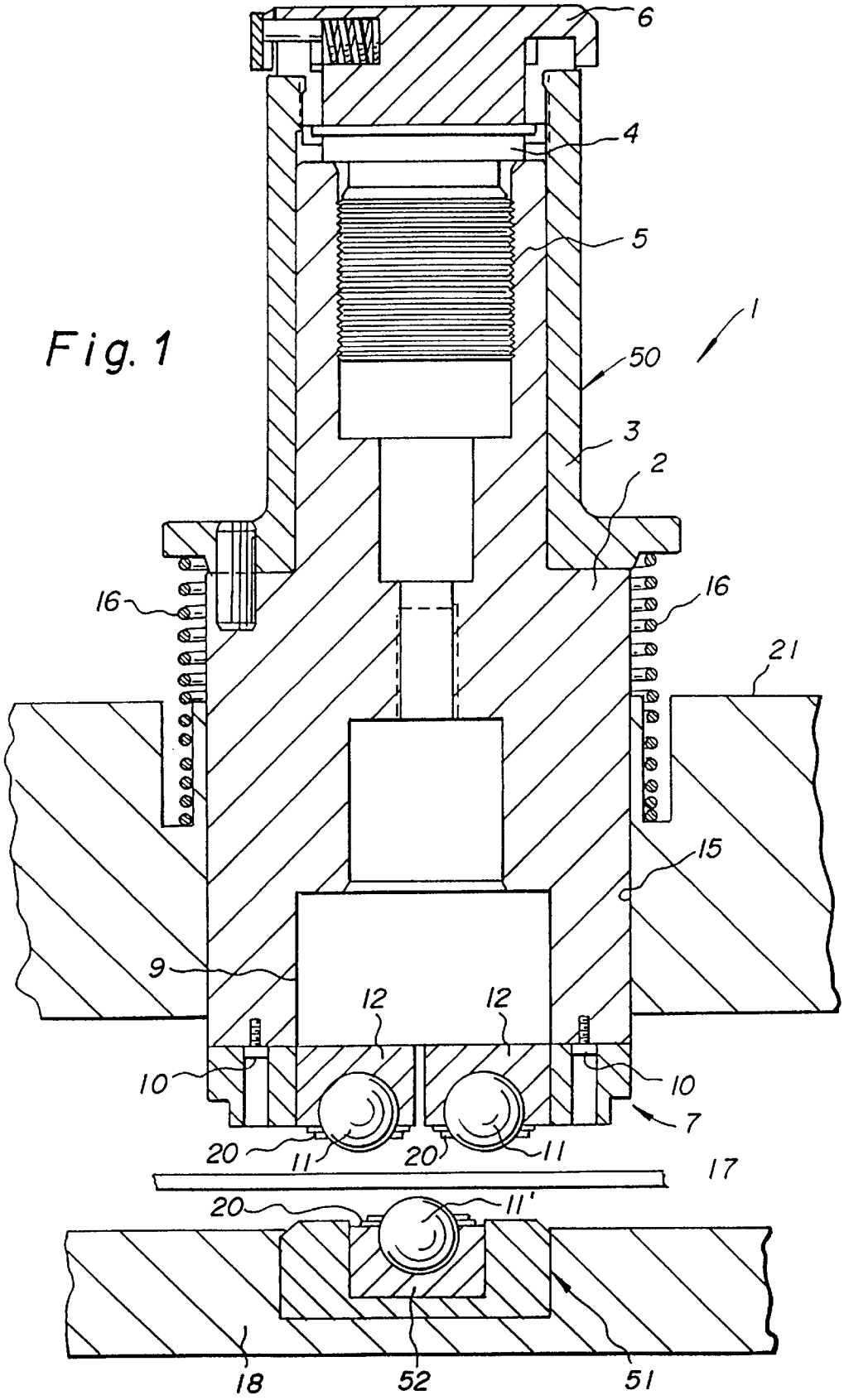
FIG. 1 is a vertical cross-sectional view of the deforming tool of the invention, positioned in a turret bore of a punch press.

FIG. 1 shows a tool 1 for deforming a workpiece, such as a sheet metal panel or other malleable panel. Tool 1 includes an upper part 50 having a body 2 guided in a guide 3 and also includes a lower part, namely a die 51. A workpiece 17 is positioned between the upper and lower parts 50,51 for deformation. In the embodiment shown in FIG. 1, upper part 50 is received in a turret 21 of a punch press (not shown). A driver 4 is attached to body 2 at an upper end thereof, preferably by a threaded engagement 5. The threaded engagement 5 allows for adjustment of the length of the upper part 50 as discussed in greater detail below. However, body 2 and driver 4 may be constructed as a single piece. A head 6 is attached to driver 4. In the preferred embodiment of the invention shown in FIG. 1, upper part 50 is supported in a turret bore 15 on springs 16. When a ram of a punch press (not shown) presses down on head 6, driver 4 is pressed downward, moving body 2 and roller ball assembly 7, mounted in the lower end of body 2, into engagement with the top of workpiece 17. Lower part 51 includes a roller ball 11' mounted therein and is, in turn, mounted in a lower turret 18.

Figure 2A:
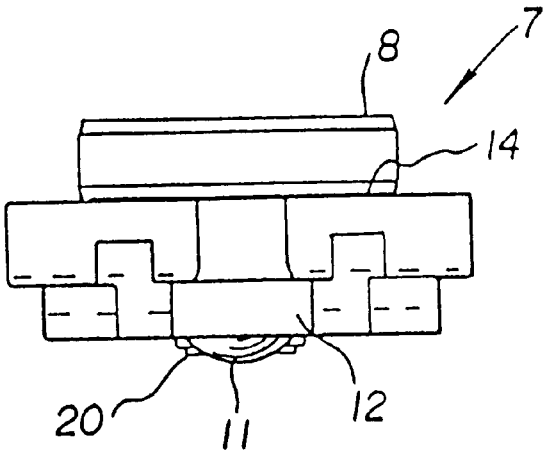
FIG. 2A is an elevational view of the roller ball assembly used in the deforming tool of the invention.

FIG. 2A shows a side view of the roller ball assembly 7. The cylindrical upper end 8 of roller ball assembly 7 is adapted to be received in a bore 9 in the lower end of body 2. Roller ball assembly 7 may be held in place in the body 2 via screws 10.

Figure 2B:
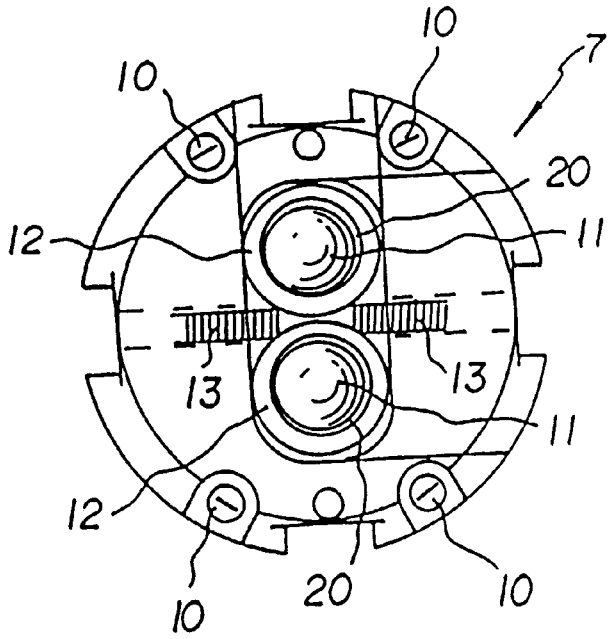
FIG. 2B is a bottom view of the roller ball assembly shown in FIG. 2A.

FIG. 2B shows a bottom view of roller ball assembly 7 into which two rotatable roller balls 11 have been inserted. Roller balls 11 are spherical and are held in place in cylindrical holders 12. Holders 12, in turn, are retained in roller ball assembly 7 via set screws 13. Holders 12 are easily released from roller ball assembly 7 by loosening set screws 13. When holders 12 are inserted into roller ball assembly 7, their upper ends abut the bottom 14 of cylindrical upper part 8.

Each of the roller balls 11,11' is mounted in a hemispherical bearing shell inside holder 12 for free universal rolling movement. Each roller ball 11,11' is held in place in holder 12 by means of a holding ring 20 which has a smaller inside diameter than the diameter of the roller balls 11,11'. Each entire unit, i.e., a holder 12, a roller ball 11 or 11' and a holding ring 20, is typically formed as part of the tool 1 or provided separately as a replacement part which is a conventional part available through McMaster-Carr, Chicago, Ill. It is easily replaced in either the upper part 50 or lower part 51.

Figure 3:
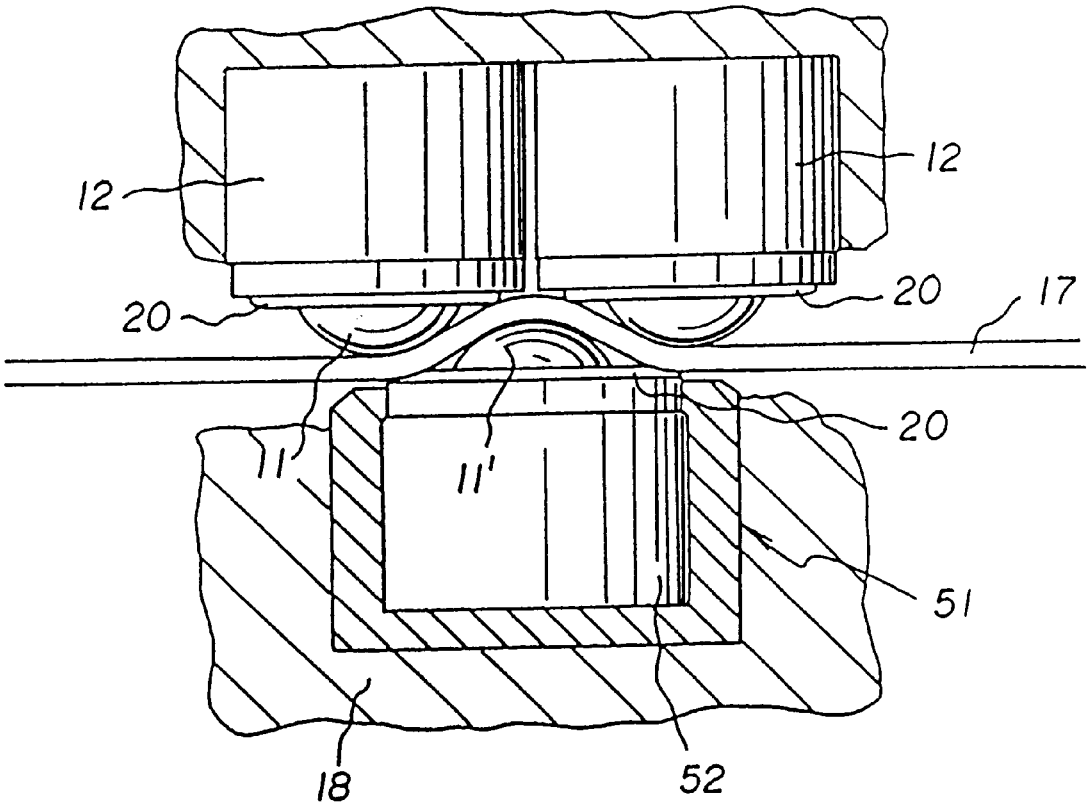
FIG. 3 is a partial cross-sectional view of the deforming tool of FIG. 1, shown in operation.

In the preferred embodiment, shown in FIGS. 1 and 3, a single roller ball 11' is provided in lower part 51. This configuration forms a wave-shaped gap between the roller balls 11 and 11'. In particular, FIG. 3 shows how the roller balls 11,11' engage the workpiece 17 when a ram acts on head 6 to move the roller ball assembly 7 into contact with the workpiece 17.

In general, the method of operation of the tool of the invention is as follows:

Workpiece 17 is positioned between upper part 50 and lower part 51. The ram of the punch press (not shown) then presses down on head 6 until both roller balls 11 and 11' are in contact with the workpiece 17. The ram continues to maintain the tool 1 in contact with the workpiece 17 throughout the deforming operation. The workpiece is then translated between the roller balls 11, 11' to create a smooth elongated deformation in the workpiece. In order to create a corner or curve shaped deformation, the workpiece is simply rotated in the desired direction. Because roller balls 11 and/or 11' are mounted for free universal rolling movement, i.e., over a 360 degree range in any direction, it is possible to make sharp turns in the workpiece and avoid the damage to the workpiece which occurs with cylindrical-shaped rollers that are not capable of such universal rolling movement.

Figure 4A:
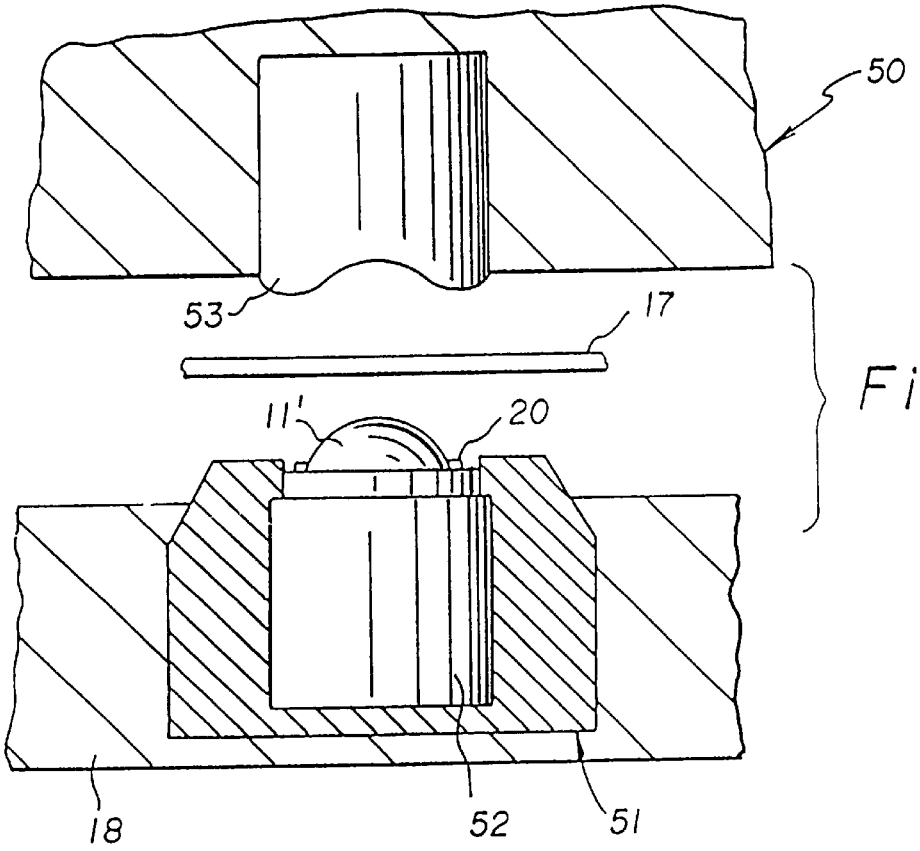
FIGS. 4A and 4B are schematic views showing modifications of the deforming tool of the present invention.

As shown in FIG. 4A, upper part 50, or lower part 51 may be provided with one or more static members 53 conforming to the shape of the roller balls 11, or 11', respectively and in which the roller balls 11, 11' are guided to deform the workpiece 17.

Figure 4B:
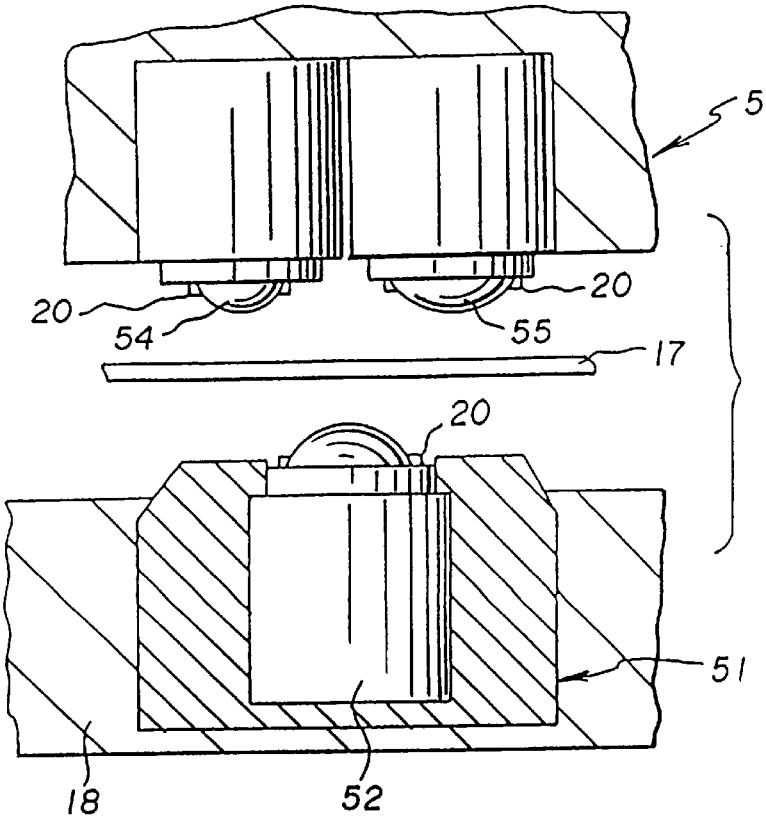

As shown in FIG. 4B, roller balls of differing diameters may be utilized. In the embodiment shown, roller ball 54 is smaller than roller ball 55 which increases the ease of forming structures such as a flange.

Figure 5:
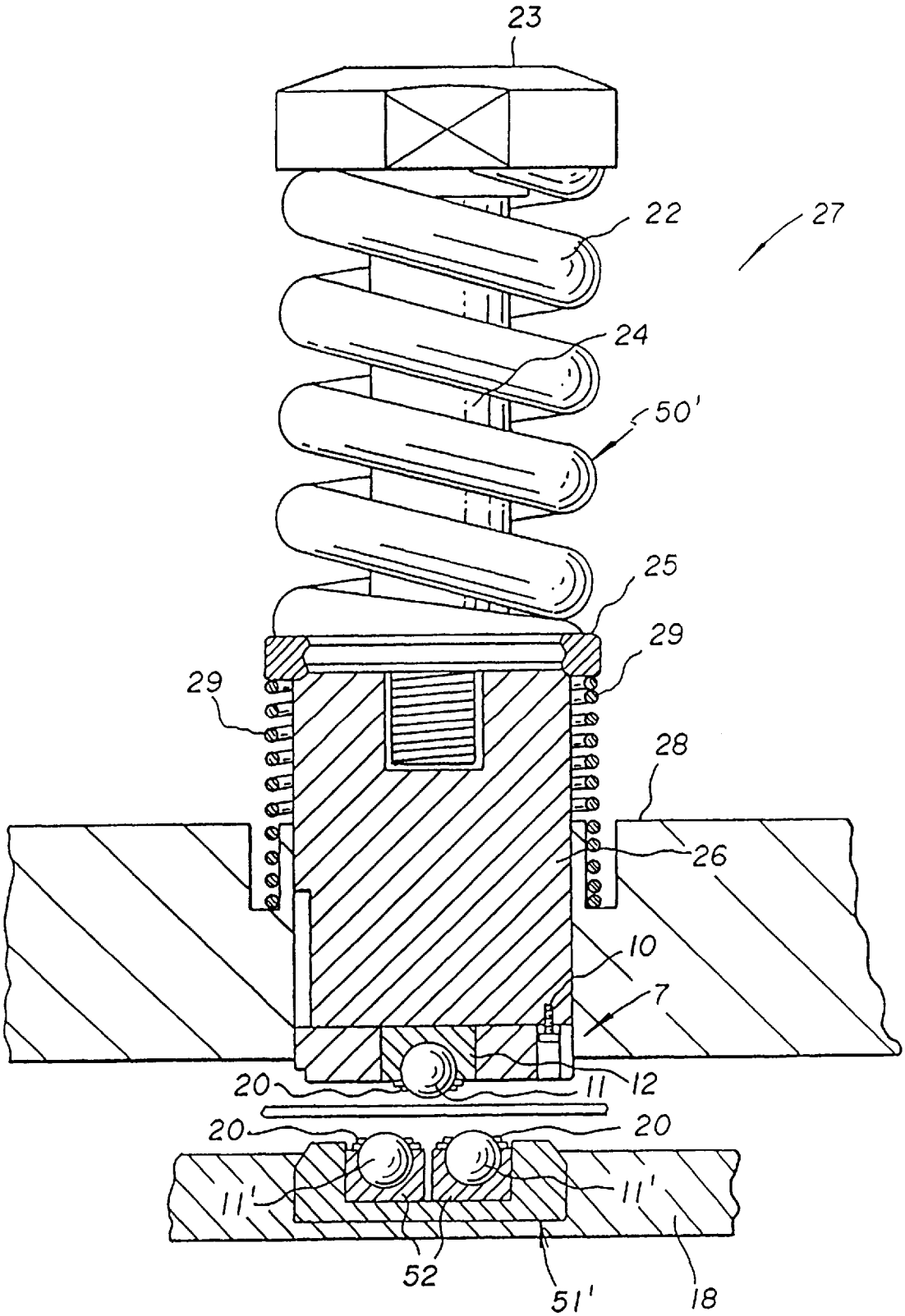
FIG. 5 is a vertical cross-sectional view showing a modified deforming tool, positioned in a turret bore of a punch press.

It is also possible to mount a s ingle roller ball 11 in the upper part 50 and two roller balls 11' in the lower part 51, as shown, for example, in FIG. 5, discussed in greater detail below. To produce several grooves simultaneously, or grooves of special cross-sectional shapes, additional roller balls, as well as roller balls in different axial positions, may be utilized.

Although driver 4 and body 2 may be constructed as a single piece, in the preferred embodiment, driver 4 and body 2 are constructed as two pieces connected by the threaded connection 5. By rotating driver 4 with respect to body 2, it is possible to perform minute changes in the length of the upper part 50. During a deforming operation, rotation of the driver 4 with respect to the body 2, as well as rotation of the body 2 with respect to the guide 3 or turret 21 is prevented by any number of known means, such as a pin in one member which fits in a slot of the other member.

In the preferred embodiment, as shown in FIG. 1, tool 1 is seated in turret bore 15 and rests on springs 16. Alternatively, or additionally, lower part 51 may be seated in lower turret 18 on springs (not shown). The springs 16, or corresponding springs in the lower part 51, provide some resiliency to account for minor variations in the plane of the workpiece and to provide some tolerance for errors in adjustment of the length of the tool. Moreover, the roller balls of the invention may be used in any number of different tool configurations. As shown in FIG. 5, roller balls 11,11' are used in conjunction with a tool of the type having a compression spring 22 positioned between the head 23 at the rear end of a driver 24 and a flange 25 at the upper end of the body 26. Upper part 50' of tool 27 is shown mounted in a turret 28 of a punch press (not shown) and seated on springs 29. It is also within the scope of the invention to utilize a tool which is not seated on springs 29 or which does not include a compression spring 22. Moreover, it is possible to use the roller balls of the invention in a tool of the type used in punch presses without a turret.

Figure 6:
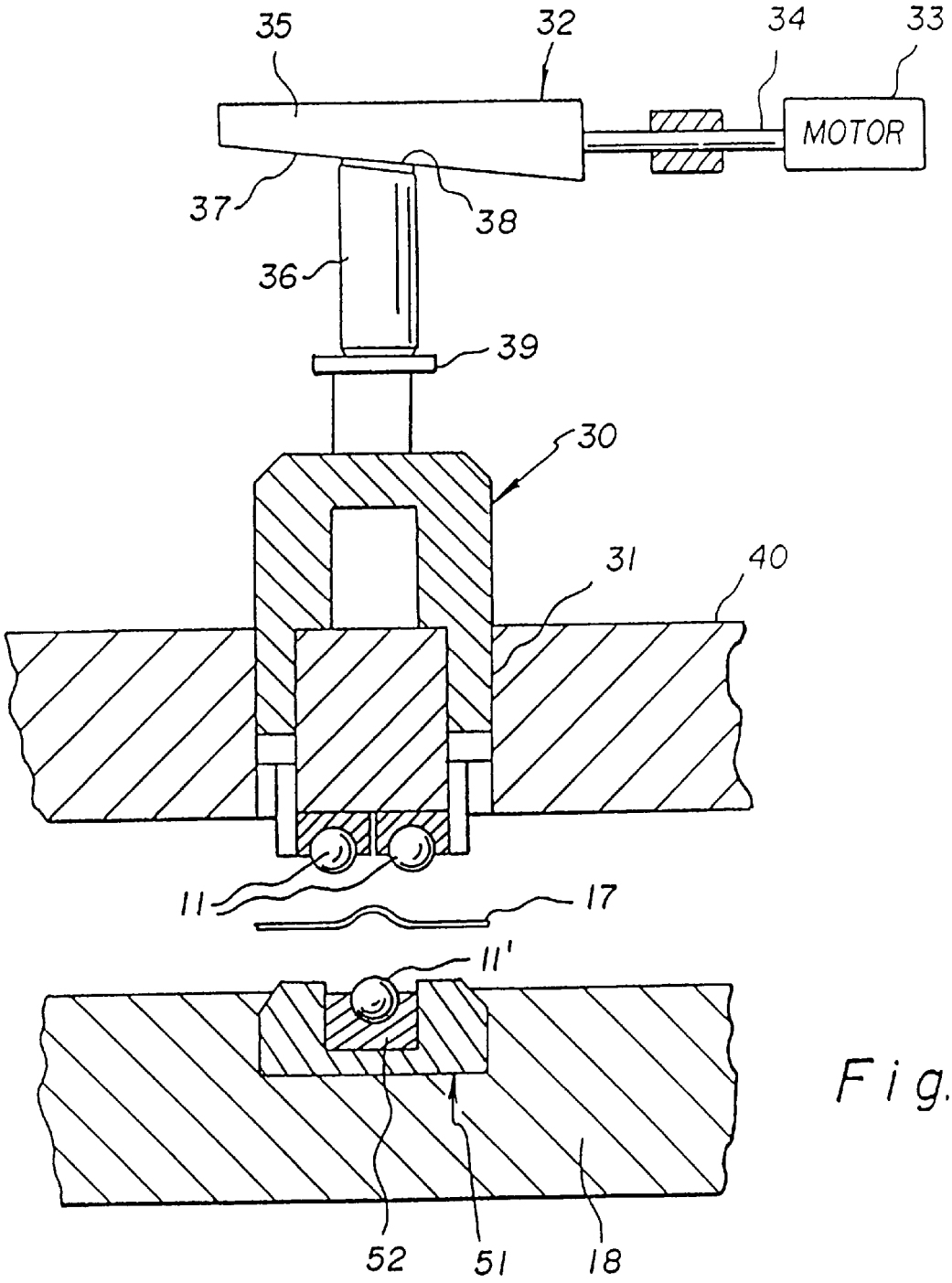
FIG. 6 is a vertical cross-sectional view of another embodiment of a deforming tool, positioned in a turret bore of a punch press.

FIG. 6 shows an embodiment of the invention in which tool 30 is positioned in a turret bore 31 without the use of springs. Tool 30 is axially movable by a spindle-type drive 32 rather than a ram. Drive 32 includes a motor 33, which may be electric, pneumatic or hydraulic, that works in conjunction with a threaded spindle 34, a pusher element 35 and a pressure element 36. The pusher element 35 has an inclined surface 37 which cooperates with a further inclined surface 38 at the top of pressure element 36. A large transmission ratio results in accordance with the pitch of the threaded spindle 34 and inclination of the inclined surfaces 37,38 such that large advancement forces are achieved with a comparatively small motor 33. Moreover, minute adjustments in the distance between the roller and workpiece is possible.

Inclination of the inclined surfaces 37,38 causes self-locking of the drive 32 at a desired operating position, which relieves the threaded spindle 34 and the motor 33 of holding forces after the tool 30 has reached the desired operating position. An interlocking guide between the pressure element 36 and the pusher element 35 is provided, for example, in the form of an undercut groove (not shown), which extends parallel with the inclined surfaces 37,38 and which permits a retraction of the tool 30 from the working position by means of reversing the direction of rotation of the motor 33. A rigid connection is also provided between the pressure element 36 and the tool head 39. Other forms of interlocking connections may also be utilized.

The interlocking connection between the pusher element 35 and the tool head 39 may be released if, for example, different tools are received in the turret 40 and the drive 32 is intended to advance these tools as soon as they are in their working position by appropriate displacement of the tool holder 40. For example, an undercut groove, open at the sides, may be located between the pressure element 36 and the tool head 39 to permit lateral engagement and disengagement of an appropriately designed projection.

Although the invention has been described in considerable detail with respect to preferred embodiments thereof, variations and modifications will be apparent to those skilled in the art without departing from the spirit and scope of the invention, as set forth in the claims.

What is claimed is:

1. A tool for deforming a workpiece comprising:

an upper part movable vertically from a raised position to a lower, workpiece engaging position; and a lower part positioned vertically beneath the upper part to cooperate with the upper part to receive a workpiece therebetween, one of the upper part and the lower part having at least one roller ball mounted therein on a fixed vertical axis for free universal rolling movement, and the other one of the upper part and the lower part having a mating element which mates with the roller ball at at least two locations on the opposite side of the workpiece from the roller ball, such that when a workpiece is moved along while engaged by the roller ball and mating element a deformation is formed in the workpiece.

2. The tool for deforming a workpiece according to claim 1, wherein said mating element comprises a roller ball mounted for free universal rolling movement.

3. The tool for deforming a workpiece according to claim 2, wherein one of said upper part and said lower part includes two roller balls mounted therein and the other one of said upper part and said lower part includes a single roller ball aligned between said first two roller balls.

4. The tool for deforming a workpiece according to claim 1, wherein said mating element comprises a static member for guiding said roller ball.

5. The tool for deforming a workpiece according to claim 1, wherein said at least one roller ball is mounted in a roller ball unit comprising a holder having a hemispherical shaped bearing shell therein in which the roller ball is rotatable, and a holding ring having an interior diameter less than the largest diameter of the roller ball for retaining said roller ball in said holder.

6. The tool for deforming a workpiece according to claim 1, wherein said upper part comprises a driver and a body attached to a front end of said driver by a threaded connection, said driver and body being rotatable with respect to each other by means of said threaded connection to allow adjustment of combined length of said driver and said body.

7. The tool for deforming a workpiece according to claim 6, wherein said body is movable in a guide, said guide including a flange extending perpendicularly outward from an outer surface of said guide and said driver including a head positioned at an upper end thereof, said upper part further including a compression spring seated between said flange and said head.

8. A tool for deforming a workpiece comprising:

an upper part movable vertically from a raised position to a lower, workpiece engaging position, said upper part comprising a driver and a body attached to said driver by a threaded connection, said driver and body being rotatable with respect to each other by means of said threaded connection to allow adjustment of a combined length of said driver and said body;

a lower part positioned vertically beneath the upper part to cooperate with the upper part to receive a workpiece therebetween;

two roller balls mounted in the lower portion of said upper part for engaging a top of said workpiece; and a single roller ball positioned on a fixed vertical axis in said lower part for engaging a bottom of the workpiece, said single roller ball being aligned between the two roller balls in said upper part, the roller balls of the upper part mating with the single roller ball of the lower part at at least two locations such that when a workpiece is moved along while engaged by the roller balls, a smooth deformation is formed in the workpiece.

9. The tool for deforming a workpiece according to claim 8 wherein each of said roller balls is mounted in a roller ball unit comprising a holder having a hemispherical-shaped bearing shell therein in which the roller ball is rotatable, and a holding ring having an interior diameter less than the largest diameter of the roller ball for retaining said roller ball in said holder.

10. The tool for deforming a workpiece according to claim 8 wherein said body is movable in a guide, said guide including a flange extending perpendicularly outward from an outer surface of said guide and said driver including a head positioned at an upper end thereof, said upper part further including a compression spring seated between said flange and said head.

11. A method of deforming a workpiece using a vertically oriented tool having upper and lower parts to form an elongated deformation in the workpiece, comprising:

engaging a top of the workpiece with the upper part of the tool which is movable vertically downward onto the workpiece;

engaging a bottom of the workpiece with the lower part of the tool, one of the upper and lower parts including a universally rolling roller ball mounted on a fixed axis, the other of the upper and lower parts including a mating element which mates with the roller ball at at least two locations on the opposite side of the workpiece from the roller ball to form an elongated deformation in the workpiece; and moving the workpiece while engaged by the roller ball and mating element to form an elongated deformation therein.

12. The method of deforming a workpiece according to claim 11, wherein said upper part comprises a driver and a body attached to a front end of said driver by a threaded connection, said method further comprising adjusting combined length of the driver and the body by rotating the driver with respect to the body prior to said step of engaging.

13. The method according to claim 11, wherein said step of engaging the top of the workpiece is performed against a spring force which biases the upper part of the tool vertically away from the workpiece.

* * * * *